US011699417B2

(12) United States Patent
Xu

(10) Patent No.: US 11,699,417 B2
(45) Date of Patent: Jul. 11, 2023

(54) AUXILIARY STRING PRESSING DEVICE FOR GUITAR PLAYING

(71) Applicant: Zhengqi Xu, Wenzhou (CN)

(72) Inventor: Zhengqi Xu, Wenzhou (CN)

( * ) Notice: Subject to any disclaimer, the term of this patent is extended or adjusted under 35 U.S.C. 154(b) by 311 days.

(21) Appl. No.: 17/251,775

(22) PCT Filed: May 27, 2019

(86) PCT No.: PCT/CN2019/088471

§ 371 (c)(1),
(2) Date: Dec. 11, 2020

(87) PCT Pub. No.: WO2019/237907

PCT Pub. Date: Dec. 19, 2019

(65) Prior Publication Data

US 2021/0118412 A1 Apr. 22, 2021

(30) Foreign Application Priority Data

Jun. 14, 2018 (CN) ..... 201810619919.7

(51) Int. Cl.
*G10D 3/00* (2020.01)
*G10D 1/08* (2006.01)

(52) U.S. Cl.
CPC ..... *G10D 3/00* (2013.01); *G10D 1/08* (2013.01)

(58) Field of Classification Search
CPC ..... G10D 3/00; G10D 1/08
See application file for complete search history.

(56) References Cited

U.S. PATENT DOCUMENTS

2012/0103165 A1* 5/2012 Hoshino ..... G10C 3/12 84/433
2013/0239772 A1* 9/2013 Perry ..... G09B 15/06 84/317

FOREIGN PATENT DOCUMENTS

| | | | |
|---|---|---|---|
| CN | 204834008 | U | 12/2015 |
| CN | 107424588 | A | 12/2017 |
| CN | 108538272 | A | 9/2018 |
| JP | 3217159 | U | 7/2018 |

* cited by examiner

*Primary Examiner* — Jianchun Qin
(74) *Attorney, Agent, or Firm* — Bayramoglu Law Offices LLC

(57) ABSTRACT

An auxiliary string pressing device for guitar playing includes a bracket, wherein the bracket having a bracket mounting structure, the bracket is provided with elastic pieces, each elastic piece having a fixed end and a movable end, the fixed end of the each elastic piece and the bracket being connected by an elastic piece fast mounting structure, a front face of the movable end of the each elastic piece is provided with a key, and a back face of the movable end of the each elastic piece being provided with a string pressing block. The auxiliary string pressing device uses an elasticity of the elastic pieces to reset, wherein a structure is simplified. The elastic piece fast mounting structure of the elastic pieces and the bracket enable the elastic pieces to be replaced by such a mounting structure.

18 Claims, 8 Drawing Sheets

AUXILIARY STRING PRESSING DEVICE FOR GUITAR PLAYING

CROSS REFERENCE TO THE RELATED APPLICATIONS

This application is the national stage entry of International Application No. PCT/CN2019/088471, filed on May 27, 2019, which is based upon and claims priority to Chinese Patent Application No. 201810619919.7, filed on Jun. 14, 2018, the entire contents of which are incorporated herein by reference.

TECHNICAL FIELD

The invention relates to an auxiliary string pressing device for guitar playing.

BACKGROUND

The guitar is a musical instrument that requires the player's hands to operate. Generally, the fingers of the left hand are used to press different positions on the upper end of the strings (called fret), while the left hand is used to pick or strum the lower end of the strings to play the melody. Usually, the left-hand operation has a certain fixed fingering, which is called the chord technique. Only by mastering these techniques and being able to switch between these techniques skillfully and flexibly can the player accompany the song with the right hand strumming.

For guitar beginners, it is relatively easy to master the right hand operation, but it is very difficult to master the left hand fingering. The main reasons are given below: 1. the guitar strings are relatively hard, and most beginners' fingers cannot withstand the reaction force of the strings; 2. the neck of the guitar has a certain width, and there is a certain distance between the frets, for people with small hands, it is more difficult to operate with the left hand; 3. for some people, due to congenital reasons or insufficient time to practice, the left hand always cannot achieve the flexibility required for accompaniment. For the above reasons, most people finally gave up playing guitar.

For those looking for accompaniment with simple instruments, the guitar is generally considered the best choice. But because it is difficult to master the left fingering of the guitar, it takes a month or more for ordinary people to perform simple accompaniment, which is unacceptable for many people. This also affected the promotion and popularity of guitars to a certain extent.

Therefore, a guitar play auxiliary string pressing device was designed. The conventional guitar play auxiliary string pressing devices generally include keys that are in contact with and controlled by the fingers, and string pressing blocks that are connected to the keys in a certain manner and are controlled by the keys. According to the connection method between the keys and the string pressing blocks, these devices are mainly divided into two types: electronic and mechanical. Among them, the electronic keys control the action of the string pressing blocks through the circuit and electrical components. This connection method allows one key to control different string pressing block combinations through the setting of the circuit. In this way, many different chord combinations can be realized through limited keys, but this method also has problems of complex structure, high cost, big volume, and difficult operation. Moreover, this method needs to be driven by a motor, and the noise made when the motor is working will affect the experience of playing, at the same time, a large-capacity battery is also needed. Therefore, it is difficult to use and promote. The mechanical keys are generally connected to the chord blocks through pure machinery. Therefore, in general, a key can only correspond to a key block combination of one chord. Few chord combinations make the repertoires played by guitar very limited, making the learning interest of beginners be greatly reduced. At the same time, the existing mechanical type generally has many shortcomings such as unreasonable structure design and inconvenient key operation due to the space constraints.

Chinese patent CN107424588A discloses "a guitar chord device". It can be seen that the device has numerous parts and complex structure. There are only 6 keys on the device, corresponding to chord combinations composed of 6 different string pressing blocks, and the chord combination corresponding to one of the keys is fixed. At the same time, the key and its corresponding string pressing block are connected by a connecting rod, and different connecting rods cannot interfere with each other. The keys on the device and the corresponding string pressing block combinations are also fixed, that is, a device has only 6 fixed preset chords. Once music of other chords needs to be played, a device with other preset chord keys and key block combinations is needed.

SUMMARY

The purpose of the present invention is to overcome the above-mentioned shortcomings of the prior art, and provide an auxiliary string pressing device for guitar playing with simple structure, convenient use, and changeable chord combinations.

The present invention comprises a bracket, the bracket having a bracket mounting structure, the bracket being provided with elastic pieces, each elastic piece having a fixed end and a movable end, the fixed end of the elastic piece and the bracket being connected by means of an elastic piece fast mounting structure, a front face of the movable end of the elastic piece being provided with a key, and a back face of the movable end of the elastic piece being provided with a string pressing block.

Said auxiliary string pressing device for guitar playing uses the elasticity of the elastic pieces to reset, so that the structure is greatly simplified; the fast mounting structure of the elastic pieces and the bracket enables the elastic pieces to be replaced by such a mounting structure, and when playing of different chords is required, it is only necessary to replace with elastic pieces having corresponding chords.

A further technical solution of the present invention is that the mounting structure is a fast mounting structure.

The elastic pieces can be fast replaced by the fast mounting structure, which is more convenient and faster to use.

A further technical solution of the present invention is to arrange multiple layers of elastic pieces at an mounting position of an elastic piece, and a plurality of elastic pieces are superimposed on each other at the fixed end, and the lead-out portions of the fixed ends of adjacent elastic pieces superimposed on each other are spaced by a certain distance.

After the above arrangement is adopted, the space can be used more reasonably, and the overall strength and elastic restoring force of the elastic piece can be ensured at the same time.

A further technical solution of the present invention is to provide an active associated part on one or more elastic pieces, and the active associated part abuts or is very close to the front face of the passive associated part of another elastic piece.

Different chords may be pressed to the same one or more strings in the same one or more frets. The prior art can only set multiple string pressing blocks in the same area under the above circumstances. On one hand, this will make the layout of the space cramped and the structure setting unreasonable. On the other hand, different string pressing blocks in the same area have different positions and different strengths to press the strings, which will result in unsatisfactory performance. The above structure can solve the above shortcomings of the prior art.

BRIEF DESCRIPTION OF THE DRAWINGS

The specific contents of the present invention is further illustrated below with reference to the drawings and examples.

DETAILED DESCRIPTION OF THE EMBODIMENTS

Figure 1:
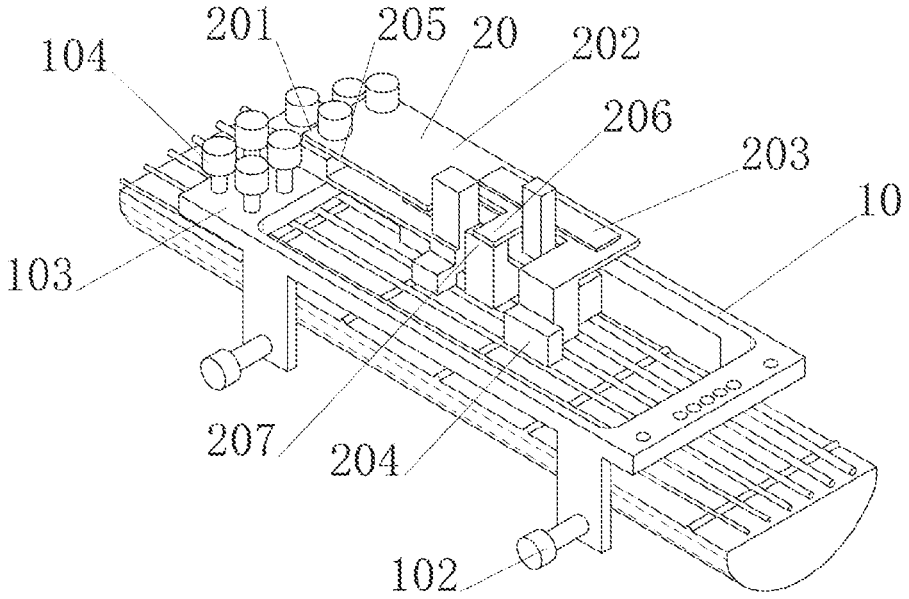
FIG. 1 shows a schematic diagram of structure of this device mounted on the guitar neck and mounted with part of the elastic piece.
Figure 2:
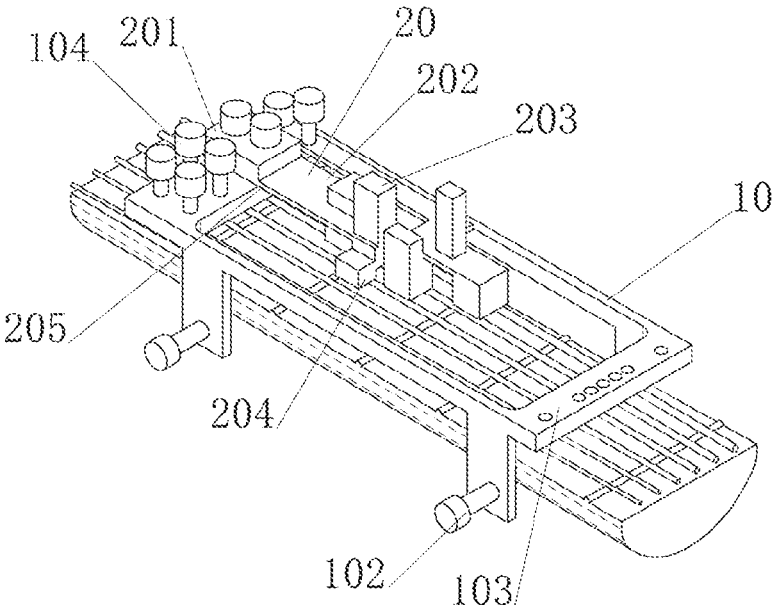
FIG. 2 shows a schematic diagram of the structure of FIG. 1 after removing the top elastic piece.
Figure 3:
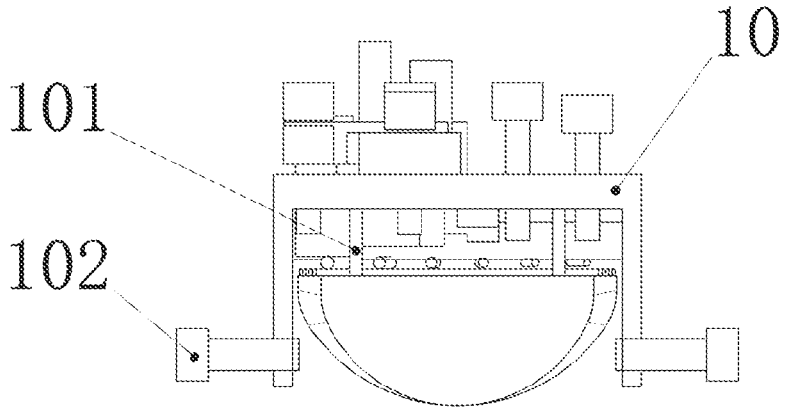
FIG. 3 shows a schematic diagram of the structure of FIG. 1 in the cross-sectional direction.
Figure 4:
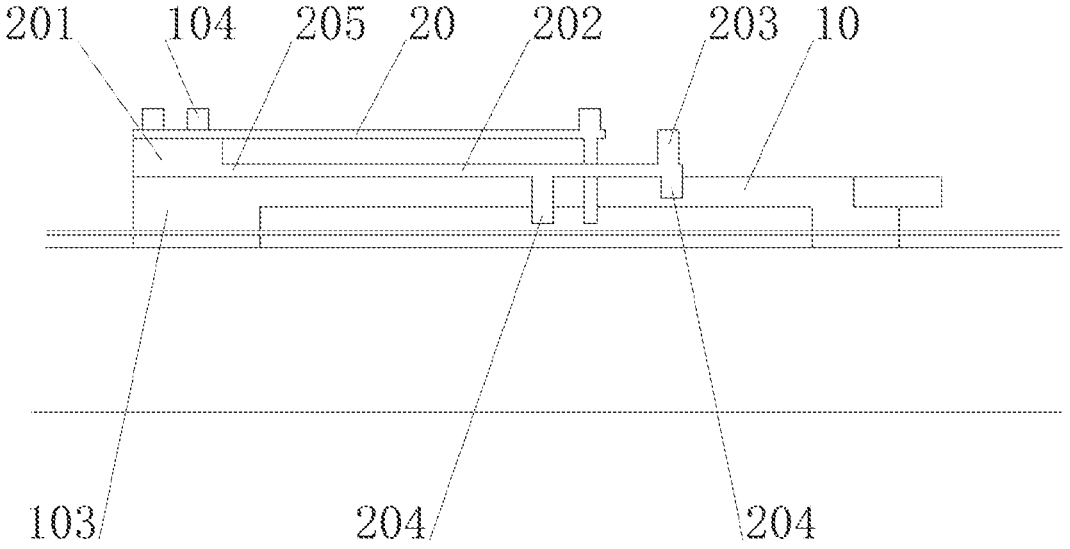
FIG. 4 shows a schematic: diagram of the unassociated structure of the multilayer elastic piece.
Figure 5:
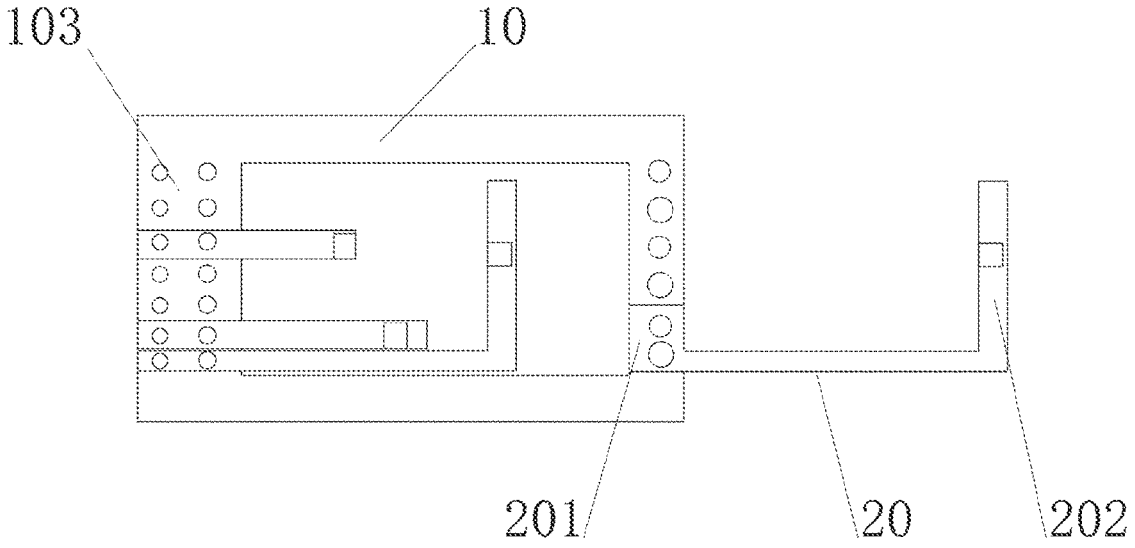
FIG. 5 shows a schematic diagram of the structure of the bracket layout solution 1.
Figure 6:
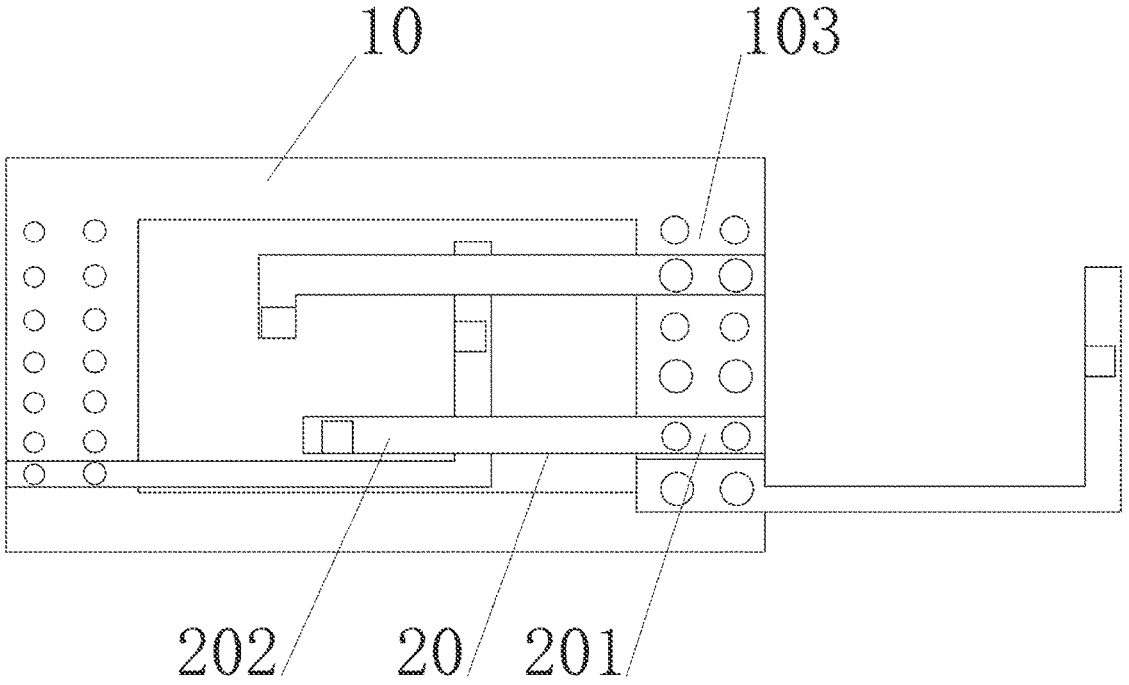
FIG. 6 shows a schematic diagram of the structure of the bracket layout solution 2.
Figure 7:
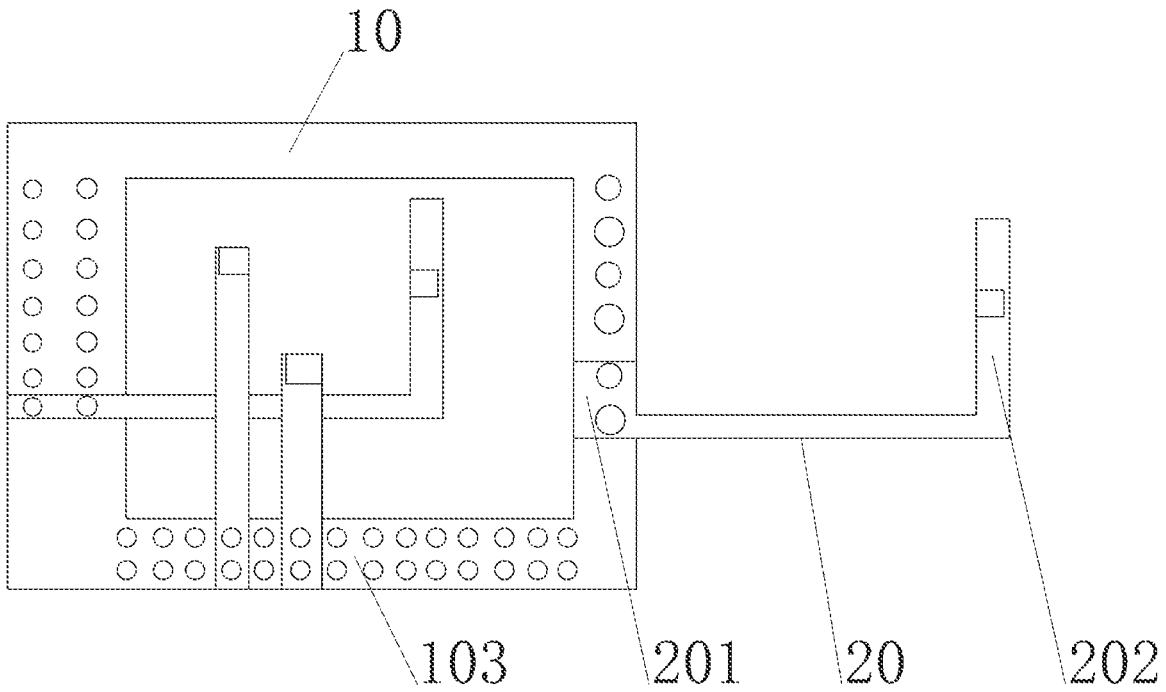
FIG. 7 shows a schematic diagram of the structure of the bracket layout solution 3.
Figure 8:
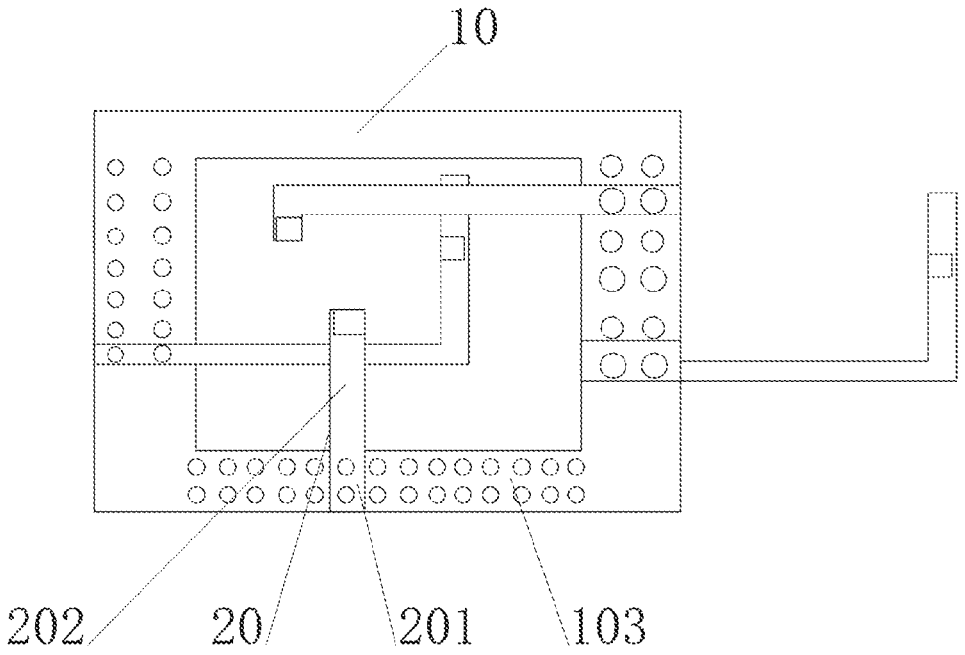
FIG. 8 shows a schematic diagram of the structure of the bracket layout solution 4.
Figure 9:
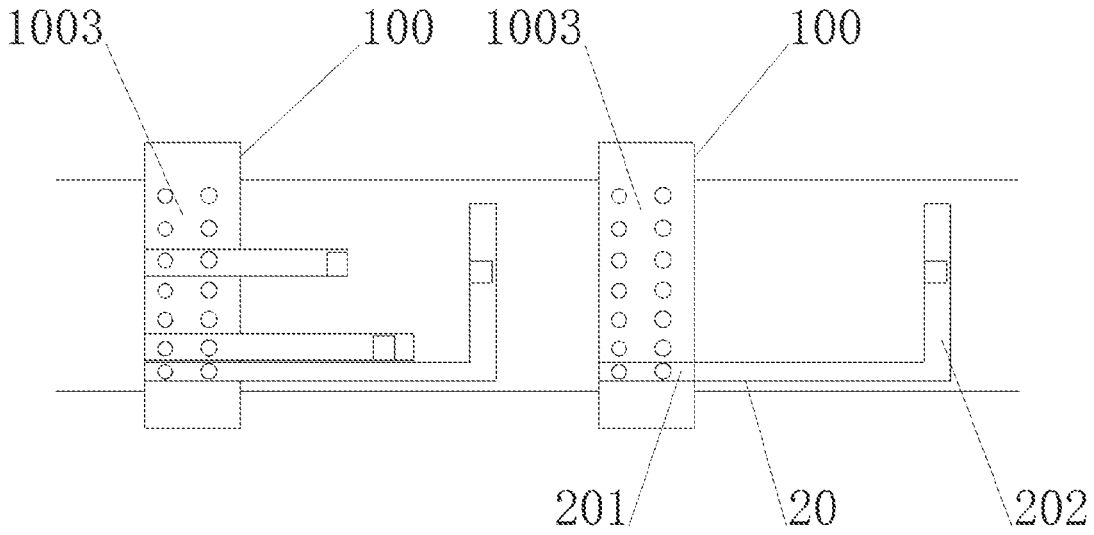
FIG. 9 shows a schematic diagram of the bracket split structure layout plan one.
Figure 10:
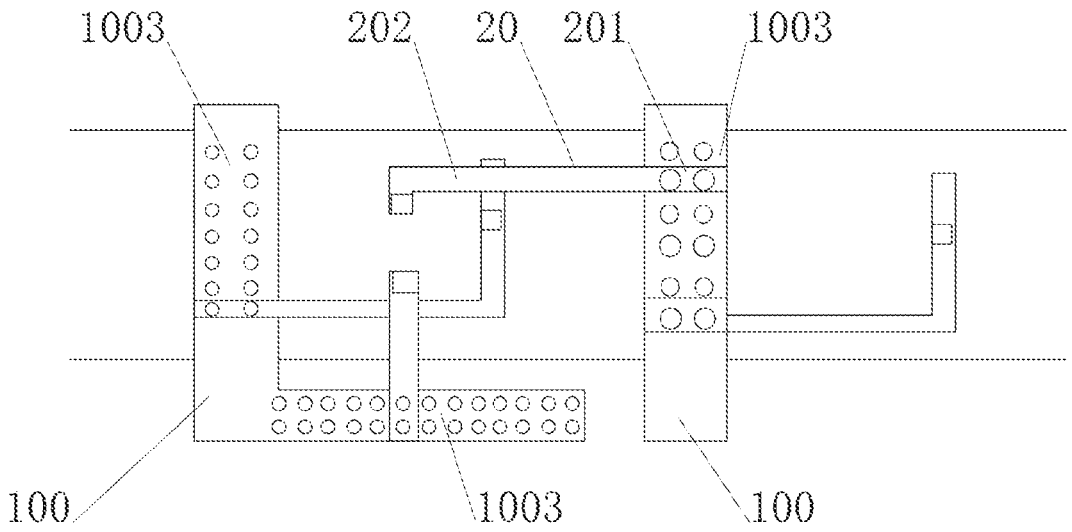
FIG. 10 shows a schematic diagram of the bracket split structure layout solution 2.
Figure 11:
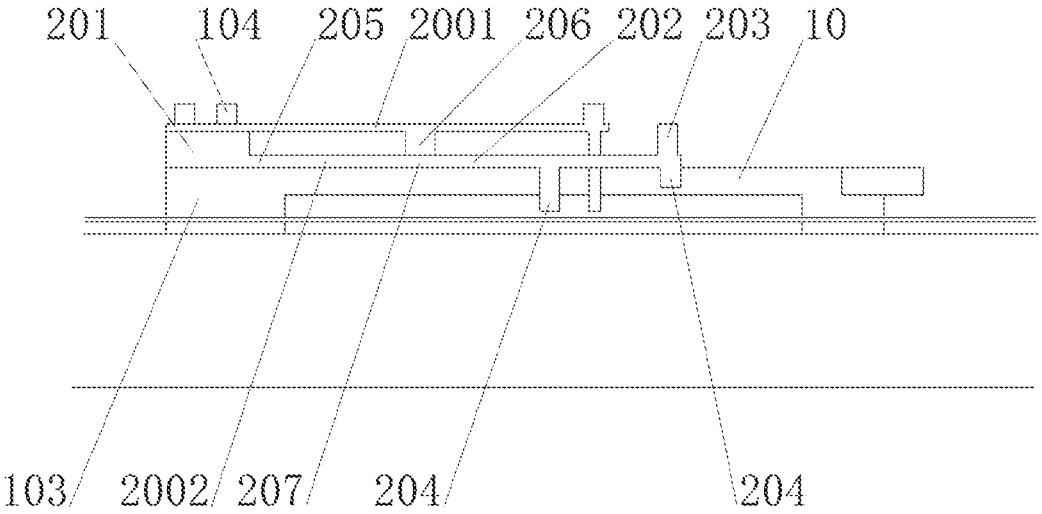
FIG. 11 shows a schematic diagram of the structure of multilayer elastic piece association solution 1.
Figure 12:
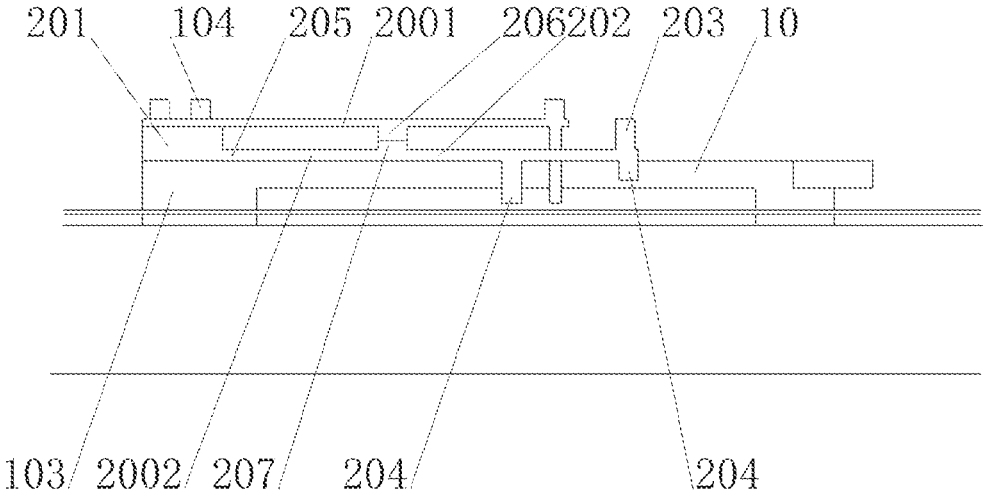
FIG. 12 shows a schematic diagram of the structure of multi-layer elastic piece association solution 2.
Figure 13:
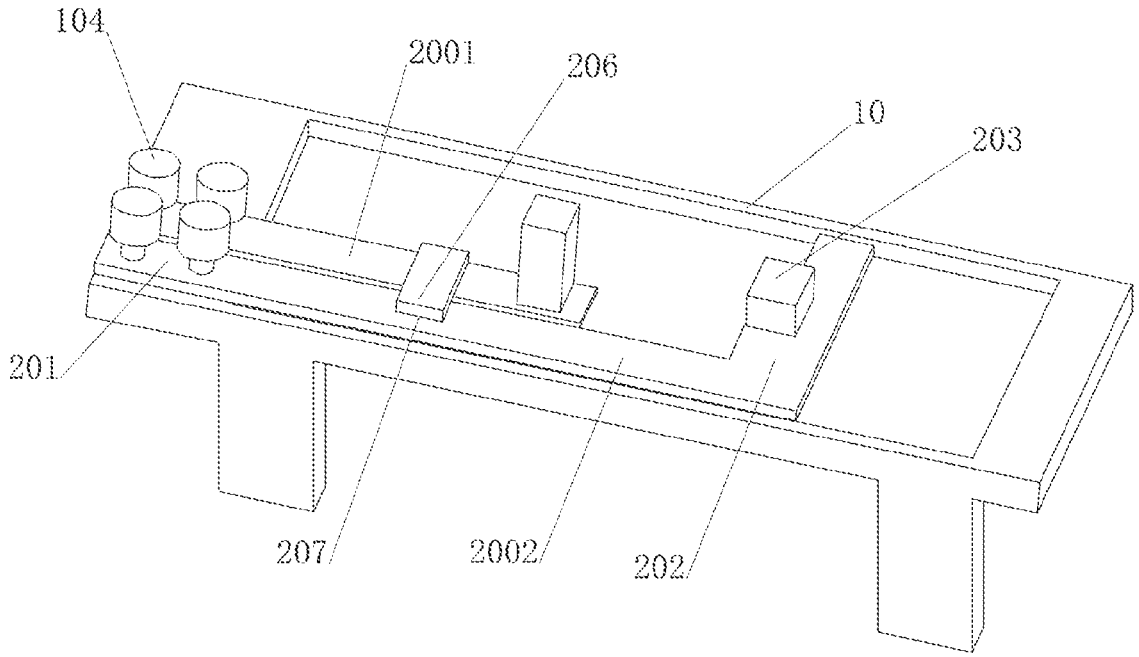
FIG. 13 shows a schematic diagram of the structure of single-layer elastic piece association solution.

As shown in the figures, the present invention comprises a bracket 10, which has a bracket mounting structure that can mount the bracket on the neck of a guitar. The specific structure of the mounting structure in this example is: the bracket 10 has feet 101 that can be supported on the fingerboard on the front face of the guitar neck, and the bracket 10 on both sides of the feet 101 extends toward the back face of the neck. Bracket screws 102 are provided at the extension end, and the bracket 10 can be mounted and fixed on the guitar neck by tightening the bracket screws 102.

The bracket mounting structure can also be other structural forms, and the bracket can even be integrally connected to the guitar neck.

The bracket is provided with elastic piece 20. The elastic piece 20 has a fixed end 201 and a movable end 202. The fixed end 201 of the elastic piece 20 and the bracket 10 are connected by means of an elastic piece mounting structure, and the front face of the movable end 202 of the elastic piece is provided with a key 203, and the back face of the movable end 202 of the elastic piece is provided with a string pressing block 204.

The front face of the elastic piece is the direction in which the elastic piece faces away from the guitar fingerboard after the device is mounted on the guitar neck, and the back face of the elastic piece is the direction in which the elastic piece faces the guitar fingerboard after the device is mounted on the guitar neck.

The movable end of the elastic piece extends along the extension direction of the elastic piece, and then can be defined into any shape according to the distribution of the connected string pressing blocks and the mutual positional relationship with other elastic pieces. When the string pressing blocks controlled by an elastic piece are all in the extension direction of the elastic piece, the movable end of the elastic piece only needs to extend in the extension direction; when the string pressing block controlled by an elastic piece is in the circumferential direction of the extension direction of the elastic piece, the movable end of the elastic piece extends in the direction of the string pressing block and covers the front face of the string pressing block and is connected to the string pressing block.

As a part of the elastic piece mounting structure, the bracket 10 needs to have a part 103 for accommodating the mounting of the fixed end of the elastic piece. The part 103 on the bracket for accommodating the mounting of the fixed end of the elastic piece may be in one-sided direction of the circumferential direction of the front face of the bracket 10, may also be multi-sided direction of the circumferential direction of the front face of the bracket 10. Generally speaking, it is more appropriate for this part to be arranged on the side of the frame 10 leaning toward the headstock direction or/and the body direction. These two positions allow the elastic piece 20 to extend longer. When the part 103 for accommodating the fixed end of the elastic piece is arranged in the direction of one side toward the body, the movable end 202 of the elastic piece can extend in the direction of the headstock or the body. When the movable end 202 of the elastic piece extends to the direction of the body, the device can press the strings on frets farther apart.

The bracket 10 can be a one-piece structure or a split structure. When the bracket 10 is a split structure, each relatively independent bracket part 100 is provided with a corresponding independent bracket mounting structure. At the same time, the bracket of the split structure is provided with a corresponding independent part 1003 for accommodating the mounting of the fixed end of the elastic piece in each relatively independent bracket part 100. In this way, when playing some complicated repertoires with a large span of chord key positions, each part 100 of the bracket can be mounted at a distance far apart from each other on the guitar neck while keeping the size of the bracket within a small range. Compared with the one-piece structure, the split structure has a smaller volume, but it is inconvenient to mount, and the stability after mounting is slightly worse.

As a better solution, the elastic piece mounting structure uses a fast mounting structure, making it more convenient and quicker to replace the elastic piece. The fast mounting structure refers to a mounting structure that can be mounted or disassembled in a short time by using manual or simple tools. The fast mounting structure used can be a screw mounting structure, a nut mounting structure, an eccentric cam clamping mounting structure, a snap structure and so on. This example uses a screw mounting structure, that is, the part 103 for accommodating the mounting of the fixed end of the elastic piece on the bracket 10 is provided with a screw hole, the fixed end 201 of the elastic piece is provided with a corresponding through hole, and the screw 104 passes through the through hole of the fixed end 201 of the elastic piece to mount and fix the fixed end 201 of the elastic piece on the screw hole of the bracket 10. In order to achieve a better effect, i.e. achieving fixation and positioning at the same time, one mounting structure can use two screws, or one screw plus a positioning structure.

In order to make better use of space, in this example, multiple layers of elastic pieces 20 are arranged on the mounting position of one or more elastic pieces 20, and multiple elastic pieces 20 are superimposed on each other at the fixed end 201, the lead-out portions 205 of the fixed end 201 of the elastic pieces that are superimposed on each other and adjacent are spaced by a certain distance. In order to achieve the above-mentioned structural arrangement, a spacer can be arranged between the fixed ends of the elastic pieces that are superimposed on each other and adjacent, or the thickness of one or more fixed ends of the elastic pieces can be increased to be greater than the thickness of the lead part of the fixed end of the elastic pieces, or the fixed ends of two or more elastic pieces that are superimposed on each other are integrally formed.

The use of the above structure can increase the number of elastic pieces in a limited space, make more reasonable use of space and arrange the elastic pieces more reasonably, increase the width of the elastic pieces at the fixed end while ensuring the number of elastic pieces, reduce the difficulty to manufacture the elastic pieces, increase the strength of a single elastic piece and ensure the elastic recovery force of the elastic pieces.

It is unidirectional association between at least two elastic pieces 20. The unidirectional association between the elastic pieces means that when an actively associated elastic piece 2001 is pressed, another passively associated elastic piece 2002 will be driven by it to perform a pressing action, so that the string pressing block 204 on the active associated elastic piece 2001 and the string pressing block 204 on the passively associated elastic piece 2002 simultaneously press the strings, and when the passively associated elastic piece 2002 is pressed, the actively associated elastic piece 2001 unidirectionally associated with it will not be affected. In this example, the specific structure is that one or more elastic pieces 20 are provided with an active associated part 206 which abuts or is very close to the front face of the passive associated part 207 of another elastic piece 20. The active associated part and the passive associated part may be a part of the elastic piece, or may be an associated block that is fixed to the elastic piece and protrudes on the surface or/and side of the elastic piece. Both the active associated part and the passive associated part may be in the form of an associated block, or only one of them may be an associated block, or both may be part of the elastic piece. The associated block can be arranged on the edge of the elastic piece, abutting or being very close to the front or back face of another elastic piece or another associated block on another elastic piece adjacent to the edge, or it can be arranged in the back face of elastic pieces in the outer layer that are superimposed on each other, abutting or being adjacent to the front face of the elastic piece on the inner layer, or it can be arranged on the front face of the elastic piece on the inner layer that are superimposed on each other, abutting or being adjacent to the back face of the elastic piece on the outer layer. In this way, after the actively associated elastic piece is pressed, the passively associated elastic piece is pressed by the contact between the active associated part and the passive associated part to achieve linkage. If only the passively associated elastic piece is pressed, the actively associated elastic piece will not be pressed. The same elastic piece can be actively associated with multiple other elastic pieces at the same time. The same elastic piece can be passively associated with multiple other elastic pieces. The same elastic piece can be passively associated with other elastic pieces while actively associated with another elastic piece. This structure makes the same string in the same fret have only one corresponding string pressing block, so that the internal space of the entire device is wider and the space utilization is more reasonable.

In this example, one movable end 202 of the elastic piece corresponds to one fixed end 201 of the elastic piece, and each fixed end 201 of the elastic piece is relatively independent and is separately mounted and fixed on the bracket 10. The advantage of this is that when the elastic piece needs to be replaced when repertoire with different chords needs to be played, only the elastic piece corresponding to the changed string pressing block needs to be replaced. The number of the entire set of elastic pieces is relatively small, so the cost is low. However, when mounting and replacing, the operator needs to mount the corresponding elastic pieces to the correct position according to the instructions or according to the mark, which will be slightly troublesome.

As an improved structure of the present invention, the fixed ends 201 of multiple elastic pieces can be fixedly connected by adhesion, covering, integral molding and other forms to form a combined body, and then the combined body and the bracket 10 are connected by the elastic piece mounting structure. With this structure, it is only necessary to connect the combined body and the bracket, which greatly reduces the number of parts that need to be connected. At the same time, the structure of the connecting part of the bracket and the elastic piece is simpler, and the operation is easier and more convenient. However, the number of the whole set of elastic piece combined body is relatively large, and the cost is relatively high.

The main function of the key 203 on the elastic piece of the present invention is to allow the left hand to locate the pressing point of the corresponding elastic piece by touch when playing. At the same time, for the elastic piece located in the lower layer that is not exposed on the entire surface of the device, the function of the keys thereon allows the fingers to act from the outside and press the elastic piece. Therefore, for the elastic piece located in the lower layer, the keys thereon should protrude from the front face of the elastic piece. As for the elastic piece located on the uppermost layer of the front face, the keys thereon do not need protrusion setting, and only the finger touch of the pressing point can be different from the rest of the elastic piece. Therefore, for the elastic piece located on the uppermost layer of the front face, the keys thereon may be patches or inserts with different materials, or use different surface textures, or various forms such as grooves.

The shape of the movable end 202 of the elastic piece in the present invention is not limited to the shape of a flat plate.

What is claimed is:

1. An auxiliary string pressing device for guitar playing, comprising a bracket, wherein the bracket comprises a bracket mounting structure, wherein the bracket is provided with elastic pieces, each elastic piece has a fixed end and a movable end, the fixed end of the each elastic piece and the bracket are connected by an elastic piece fast mounting structure, a front face of the movable end of the each elastic piece is provided with a key, and a back face of the movable end of the each elastic piece is provided with a string pressing block; and wherein in a unidirectional association between at least two elastic pieces, an action of an actively associated elastic piece drives a passively associated elastic piece to move.

2. The auxiliary string pressing device according to claim 1, wherein the bracket is provided with a part for accommodating a mounting of the fixed end of the each elastic piece, and the part for accommodating the mounting of the fixed end of the each elastic piece is arranged on a side of the bracket leaning toward a headstock or/and a body.

3. The auxiliary string pressing device according to claim 2, wherein the bracket is provided with a screw hole, the fixed end of the each elastic piece is provided with a through hole corresponding to the screw hole, and a screw passes through the through hole of the fixed end of the each elastic piece to mount and fix the fixed end of the each elastic piece on the screw hole of the bracket.

4. The auxiliary string pressing device according to claim 3, wherein a plurality of layers of the elastic pieces are arranged at a mounting position of one elastic piece, and the elastic pieces are superimposed on each other at the fixed end, and lead-out portions of the fixed ends of adjacent elastic pieces of the elastic pieces are spaced by a certain distance.

5. The auxiliary string pressing device according to claim 3, wherein in a unidirectional association between at least two elastic pieces, an action of an actively associated elastic piece drives a passively associated elastic piece to move.

6. The auxiliary string pressing device according to claim 2, wherein a plurality of layers of the elastic pieces are arranged at a mounting position of one elastic piece, and the elastic pieces are superimposed on each other at the fixed end, and lead-out portions of the fixed ends of adjacent elastic pieces of the elastic pieces are spaced by a certain distance.

7. The auxiliary string pressing device according to claim 1, wherein the elastic piece fast mounting structure is a fast mounting structure.

8. The auxiliary string pressing device according to claim 7, wherein a plurality of layers of the elastic pieces are arranged at a mounting position of one elastic piece, and the elastic pieces are superimposed on each other at the fixed end, and lead-out portions of the fixed ends of adjacent elastic pieces of the elastic pieces are spaced by a certain distance.

9. The auxiliary string pressing device according to claim 7, wherein in a unidirectional association between at least two elastic pieces, an action of an actively associated elastic piece drives a passively associated elastic piece to move.

10. The auxiliary string pressing device according to claim 1, wherein a plurality of layers of the elastic pieces are arranged at a mounting position of one elastic piece, and the elastic pieces are superimposed on each other at the fixed end, and lead-out portions of the fixed ends of adjacent elastic pieces of the elastic pieces are spaced by a certain distance.

11. The auxiliary string pressing device according to claim 10, wherein the fixed ends of the elastic pieces are fixedly connected to form a combined body, and the combined body and the bracket are connected by the elastic piece fast mounting structure.

12. The auxiliary string pressing device according to claim 1, wherein an active associated part is provided on the actively associated elastic piece, and the active associated part abuts or is adjacent to a front face of a passive associated part of the passively associated elastic piece.

13. The auxiliary string pressing device according to claim 12, wherein the active associated part or the passive associated part of the each elastic piece is an associated block, wherein the associated block is fixedly connected to the each elastic piece and protrudes on a surface or/and a side of the each elastic piece.

14. The auxiliary string pressing device according to claim 12, wherein the active associated part or the passive associated part on the each elastic piece is a part of the each elastic piece.

15. An auxiliary string pressing device for guitar playing, comprising a bracket, wherein the bracket comprises a bracket mounting structure, wherein the bracket is provided with elastic pieces, each elastic piece has a fixed end and a movable end, the fixed end of the each elastic piece and the bracket are connected by an elastic piece fast mounting structure, a front face of the movable end of the each elastic piece is provided with a key, and a back face of the movable end of the each elastic piece is provided with a string pressing block;

wherein the bracket is a split structure, each of relatively independent bracket parts is provided with a corresponding independent bracket mounting structure, and the each of the relatively independent bracket parts is provided with a corresponding independent part for accommodating the mounting of the fixed end of the each elastic piece.

16. The auxiliary string pressing device according to claim 15, wherein a plurality of layers of the elastic pieces are arranged at a mounting position of one elastic piece, and the elastic pieces are superimposed on each other at the fixed end, and lead-out portions of the fixed ends of adjacent elastic pieces of the elastic pieces are spaced by a certain distance.

17. The auxiliary string pressing device according to claim 15, wherein in a unidirectional association between at least two elastic pieces, an action of an actively associated elastic piece drives a passively associated elastic piece to move.

18. An auxiliary string pressing device for guitar playing, comprising a bracket, wherein the bracket comprises a bracket mounting structure, wherein the bracket is provided with elastic pieces, each elastic piece has a fixed end and a movable end, the fixed end of the each elastic piece and the bracket are connected by an elastic piece fast mounting structure, a front face of the movable end of the each elastic piece is provided with a key, and a back face of the movable end of the each elastic piece is provided with a string pressing block;

wherein the bracket is provided with a part for accommodating a mounting of the fixed end of the each elastic piece, and the part for accommodating the mounting of the fixed end of the each elastic piece is arranged on a side of the bracket leaning toward a headstock or/and a body; and wherein in a unidirectional association between at least two elastic pieces, an action of an actively associated elastic piece drives a passively associated elastic piece to move.

* * * * *